US006551770B2

(12) United States Patent
Hirabayashi

(10) Patent No.: US 6,551,770 B2
(45) Date of Patent: Apr. 22, 2003

(54) HEAT DEVELOPABLE PHOTOSENSITIVE MATERIAL

(75) Inventor: Kazuhiko Hirabayashi, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/887,142

(22) Filed: Jun. 25, 2001

(65) Prior Publication Data

US 2002/0018970 A1 Feb. 14, 2002

(30) Foreign Application Priority Data

Jun. 27, 2000 (JP) ..... 2000-192604

(51) Int. Cl.[7] ..... G03C 1/498; G03C 1/74

(52) U.S. Cl. ..... 430/531; 430/523; 430/619; 430/631; 430/935

(58) Field of Search ..... 430/619, 531, 430/935, 631, 523

(56) References Cited

U.S. PATENT DOCUMENTS 2,761,791 A * 9/1956 Russell
4,009,039 A * 2/1977 Masuda et al.
5,405,740 A 4/1995 LaBelle
6,083,680 A 7/2000 Ito et al.
6,132,950 A * 10/2000 Ishigaki et al. ..... 430/619
6,140,038 A * 10/2000 Ishizuka et al. ..... 430/619
6,146,822 A * 11/2000 Asanuma et al. ..... 430/619
6,277,549 B1 * 8/2001 De Keyzer et al. ..... 430/567

FOREIGN PATENT DOCUMENTS

| | | |
|---|---|---|
| EP | 0 883 022 A | 12/1998 |
| JP | 49-52626 | 5/1974 |
| JP | 53-116144 | 10/1978 |
| JP | 11-316437 | 11/1999 |
| JP | 11-316438 | 11/1999 |

* cited by examiner

*Primary Examiner*—Thorl Chea
(74) *Attorney, Agent, or Firm*—Finnegan, Henderson, Farabow, Garrett & Dunner, L.L.P.

(57) ABSTRACT

A heat developable photosensitive material comprising at least two layers is disclosed. The first layer is formed by coating a first coating composition containing the organic silver salt, the photosensitive silver halide, the reducing agent, polymer latex in an amount of at least 30 percent by weight of the first layer at dried state and a solvent, the solvent comprising water in an amount of at least 50 percent by weight of the solvent, and the second layer is formed by coating a second coating composition comprising a polymer latex in an amount of at least 50 percent of the second layer at dried state and a solvent, the solvent comprising water in an amount of at least 60 percent by weight of the solvent, and the second coating composition having a viscosity of from 50 to 1,000 cP at 25 ° C., and the viscosity at 5° C being at least 1.5 times higher than that at 25° C.

18 Claims, 1 Drawing Sheet

HEAT DEVELOPABLE PHOTOSENSITIVE MATERIAL

FIELD OF THE INVENTION

The present invention relates to a heat developable photosensitive material, and specifically to a heat developable photosensitive material suitable for photomechanical process.

BACKGROUND OF THE INVENTION

Recently, in photomechanical process field, a decrease in processing effluent has been strongly demanded from the viewpoint of environmental protection as well as of storage space saving. Accordingly, techniques regarding heat developable photosensitive materials for use in the photomechanical process are demanded which are capable of being subjected to efficient exposure utilizing laser scanners or laser image setters and of forming clear black images with high resolution as well as high sharpness. These heat developable photosensitive materials make it possible to eliminate the use of liquid based processing chemicals and to supply the market with a simple heat developable processing system which protects the environment.

Methods which form images utilizing heat development are described, for example, in U.S. Pat. Nos. 3,152,904 and 3,457,075, and D. Morgan and B. Shely, "Thermally Processed Silver Systems" in Imaging Processes and Materials, Neblette, 8th Edition, edited by A. Sturge, V. Walworth, and A. Shepp, page 2, 1969. Such heat developable photosensitive materials (hereinafter referred to simply as photosensitive materials) generally comprise reducible non-photosensitive silver sources (for instance, organic silver salts), photocatalysts (for example, silver halides) in workable amounts as photocatalysts, and silver reducing agents which are commonly dispersed into an organic binder matrix. Said photosensitive materials are stable at normal temperature. However, when they are heated to a relatively high temperature (for example, 80° C. or higher) after exposure, silver is formed through a redox reaction between said reducible silver sources (which function as the oxidizing agents) and said reducing agents. Said redox reaction is promoted by catalytic action of a latent image formed by exposure. Silver, which is formed by the reaction of reducible silver salts in the exposed area, provides a black image in contrast to the unexposed area, whereby a visible image is formed.

Heretofore, this type of heat developable photosensitive material has been known, and the photosensitive layer of most of these photosensitive materials is formed by applying a coating composition in which organic solvents such as toluene, methyl ethyl ketone (MEK), methanol, and the like, are employed. The use of organic solvents as the solvents results in such disadvantages as adverse effects to human body in the production process, and an increase in cost for solvent recovery and the like.

Accordingly, methods have been developed in which the photosensitive layer is formed employing a coating composition comprised of water as the solvent, which largely overcomes said drawbacks. For example, Japanese Patent Publication Open to Public Inspection Nos. 49-52626, 53-116144, and others describe examples in which gelatin is employed as the binder. Employing gelatin as the binder exhibits great advantages in productivity as well as in environmental protection. However, photographic properties are markedly degraded and problems occur in which black silver images become brown; when a photosensitive layer is touched with fingers before exposure, fingerprints result in desensitization; and the like.

Further, it is known that without employing gelatin, coating is carried out employing a water based coating composition comprised of polymer latex as the binder (for example, in Japanese Patent Publication Open to Public Inspection Nos. 11-316437, 11-316438, and others). However, in such cases, problems occur in which uneven density due to development tends to be noted, and linearity deteriorates.

SUMARY OF THE INVENTION

An objective of the present invention is to provide a heat developable photosensitive material which results in improvements in image color, uneven density, and linearity.

The invention and the embodiments are described hereunder.

A heat developable photosensitive material comprising a support, a first layer containing an organic silver salt, photosensitive silver halide and a reducing agent, and a second layer which is provided on same side of the first layer and farther from the support than the first layer, wherein the first layer is formed by coating a first coating composition containing the organic silver salt, the photosensitive silver halide, the reducing agent, polymer latex in an amount of at least 30 percent by weight of the first layer in dried state and a solvent, the solvent comprising water in an amount of at least 50 percent by weight of the solvent, and the second layer is formed by coating a second coating composition comprising a polymer latex in an amount of at least 50 percent of the second layer in dried state and a solvent, the solvent comprising water in an amount of at least 60 percent by weight of the solvent, and the second coating composition having a viscosity of from 4 to 1,000 cP at 25 ° C., and the viscosity at 5 ° C. being at least 1.5 times higher than that at 25 ° C.

In the heat developable photosensitive material, the first coating composition and the second coating composition are preferably coated simultaneously, whereby the first layer and the second layer are formed.

In the heat developable photosensitive material, the second layer is preferably an outermost layer.

In the heat developable photosensitive material, the polymer latex in the second coating composition preferably has a glass transition point of from 25 to 70° C.

In the heat developable photosensitive material, the polymer latex in the first coating composition preferably has a glass transition point of from −30 to 40°0C.

In the heat developable photosensitive material, the first or second coating composition preferably comprises a phthalazine derivative.

In the heat developable photosensitive material, the second coating composition preferably comprises a thickening agent.

In the heat developable photosensitive material, the second coating composition is preferably gelled at a temperature which is at least 15° C. lower than the temperature of the second coating composition at a time of coating.

In the heat developable photosensitive material, wherein the second coating composition preferably comprises a gelation promoting agent.

A method for preparation of a heat developable photosensitive material comprising coating, on a support, a first coating composition containing the organic silver salt, the photosensitive silver halide, the reducing agent, polymer latex in an amount of at least 30 percent by weight of the first layer at dried state and a solvent, the solvent comprising water in an amount of at least 50 percent by weight of the solvent, to form a first layer and coating, a second coating composition comprising a polymer latex in an amount of at least 50 percent of the second layer at dried state and a solvent, the solvent comprising water in an amount of at least 60 percent by weight of the solvent, and the second coating composition having a viscosity of from 4 to 1,000 cP at 25°0C., and the viscosity at 5 ° C. being at least 1.5 times higher than that at 25° C., to form a second layer in same side of the first layer provided farther from the support than the first layer.

In the method, the first coating composition and the second coating composition are preferably coated simultaneously.

In the method, the first coating composition or the second coating composition is preferably coated at a coating speed of from 50 to 400 m/minute.

In the method the method, drying is preferably carried out so that said material is not brought into contact with a conveying roller.

Other embodiments of the invention are further described.

1. A heat developable photosensitive material which is prepared by simultaneously coating a support with Coating Composition 1 which comprises a polymer latex in an amount of at least 30 percent by weight of a photographic constitution layer which is formed by said Coating Composition 1 comprising at least an organic silver salt, photosensitive silver halide, and a reducing agent, and which also comprises water in an amount of at least 50 percent by weight of the solvent, and Coating Composition 2 which comprises a polymer latex in an amount of at least 50 percent of a photographic constitution layer formed by employing said Coating Composition 2, comprises water in an amount of at least 60 percent by weight of the solvent, has a viscosity of from 50 to 1,000 cP at 25° C., and also has a viscosity at 5° C. which is at least 1.5 times higher than that at 25° C. so that said Coating Composition 2 is coated on said Coating Composition 1 on said support.
2. The heat developable photosensitive material described in 1. above wherein the photographic constitution layer prepared by employing said Coating Composition 2 is the uppermost layer with respect to said support.
3. The heat developable photosensitive material described in 1. above wherein the polymer layer of said Coating Composition 2 has a glass transition point of from 25 to 70° C.
4. The heat developable photosensitive material described in 1., 2. or 3. above wherein a phthalazine derivative is incorporated into either said Coating Composition 1 or said Coating Composition 2.
5. The heat developable photosensitive material described in any one of 1. through 4. above wherein said material is prepared employing a coating speed of from 50 to 400 m/minute.
6. The heat developable photosensitive martial described in 5. above wherein said material is prepared employing the drying process after said coating in which drying is carried out so that said material is not brought into contact with the conveying rollers.
7. A heat developable photosensitive material which is prepared by simultaneously coating onto a support Coating Composition 1, which comprises a polymer latex in an amount of at least 30 percent by weight of a photographic constitution layer which is formed by employing said Coating Composition 1, comprising at least an organic silver salt, photosensitive silver halide, and a reducing agent, and which also comprises water in an amount of at least 50 percent by weight of the solvent, and Coating Composition 2, which comprises a polymer latex in an amount of at least 50 percent of a photographic constitution layer formed by employing said Coating Composition 2, also comprises a thickener, comprises water in an amount of at least 60 percent by weight of the solvent, and has a viscosity of from 50 to 1,000 cP at 25° C. so that said Coating Composition 2 is coated on said Coating Composition 1 on said support.
8. The heat developable photosensitive material described in 7. above wherein said thickener is subjected to gelation at a temperature of 15° C. lower than the temperature during the coating of said Coating Composition 2.
9. The heat developable photosensitive material described in 7. or 8. above wherein said Coating Composition 2 comprises a gelation enhancing agent.
10. A heat developable photosensitive material which is prepared by simultaneously coating onto a support with Coating Composition 1 which comprises a polymer latex in an amount of at least 30 percent by weight of a photographic constitution layer which is formed by employing said Coating Composition 1, and comprises water in an amount of at least 60 percent by weight of solvents, and Coating Composition 2 which comprises a polymer latex in an amount of at least 50 percent of a photographic constitution layer which is formed by employing said Coating Composition 2, also comprises water in an amount of at least 60 percent by weight of solvents, and is gelled at a temperature which is at least 15° C. lower than the temperature during coating so that said Coating Composition 2 is coated on said Coating Composition 1 on said support.
11. The heat developable photosensitive material described in 10. above wherein said Coating Composition 2 comprises a gelation promoting agent.

DETAILED DESCRIPTION OF THE INVENTION

Figure 1:
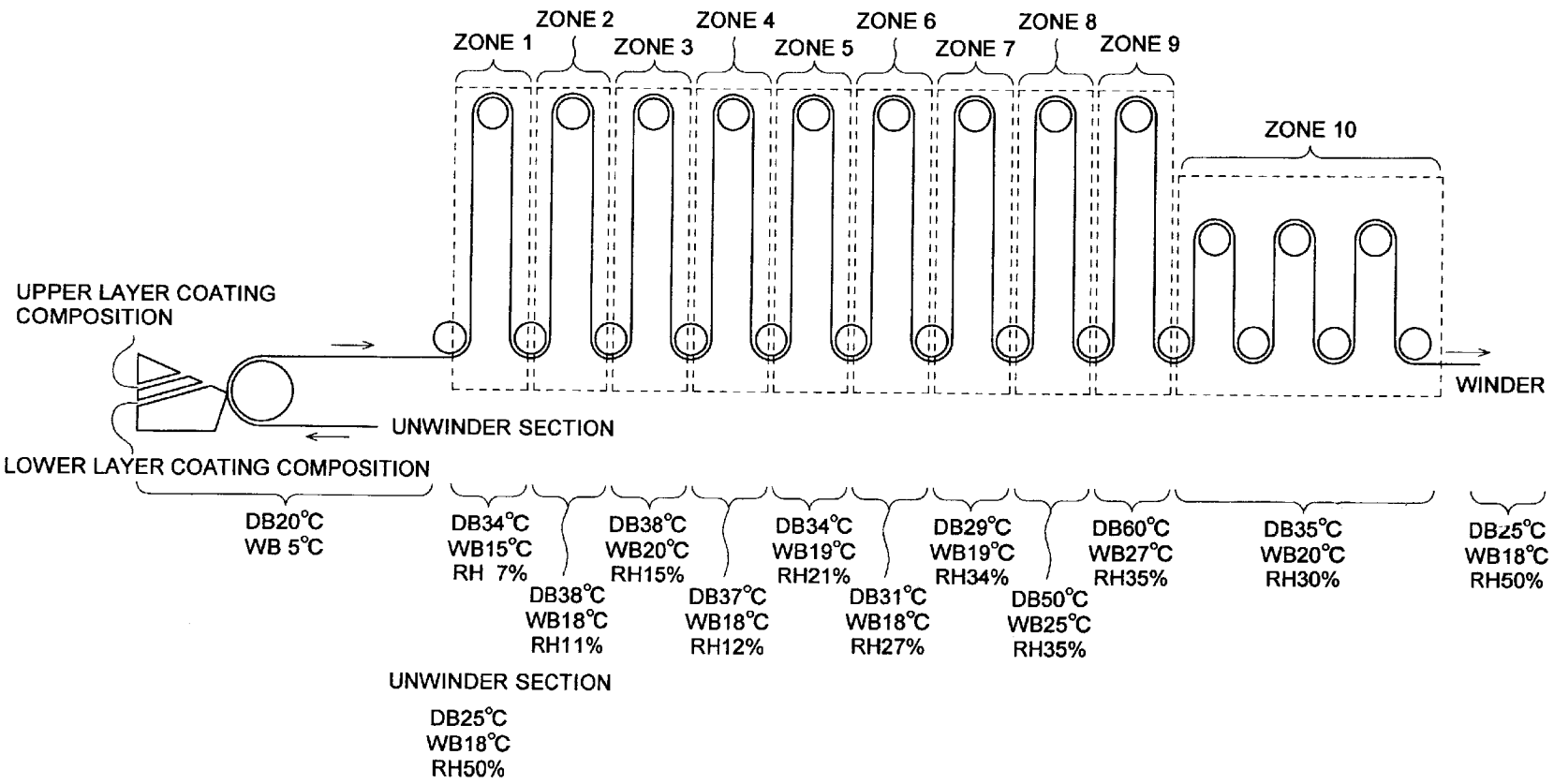
FIG. 1 is a schematic view showing drying conditions of the present invention.

The heat developable photosensitive martial of the present invention comprises a support having thereon a first photographic constitution layer comprised of organic silver salts, photosensitive silver halides, and reducing agents and a second photographic constitution layer which is provided on the same side of said first photographic constitution layer and is furtherer from said support than said first photographic constitution layer. Said first photographic constitution layer is provided by applying a first coating composition comprised of said organic silver salts, photosensitive silver halides, and reducing agents. Said second photographic layer is provided by applying a second coating composition. Said first coating composition comprises water as solvents (or dispersion media) in an amount of at least 60 percent by weight, and also comprises polymer latexes in an amount of at least 30 percent by weight with respect to the dried weight of said first photographic composition layer. Namely, when the content ratio of total solvents (or dispersion media) of said first coating composition is represented by 100 percent by weight, at least 60 percent by weight of said total solvents are water. Further, when the dried weight ratio of said first photographic composition layer is expressed by 100 percent by weight, the content ratio of said polymer latexes is at least 30 percent by weight. The content ratio is preferably 30 to 90 weight %, more preferably 35 to 80 weight %, and in particular 40 to 60 weight %. Said second coating composition comprises water as solvents (or dispersion media) in an amount of at least 60 percent by weight, and also comprises polymer latexes in an amount of at least 50 percent by weight with respect to the dried weight of said second photographic composition layer. Namely, when the content ratio of the total solvents (or dispersion media) of said second coating composition is expressed by 100 percent by weight, at least 60 percent by weight of the total solvents are water. Further, when the dried weight ratio of said second photographic constitution layer is expressed by 100 percent by weight, the content ratio of said polymer latexes is at least 50 percent by weight. The content ratio is preferably 50 to 90 weight %, more preferably 55 to 80 weight %, and in particular 60 to 80 weight %. The viscosity of said second coating composition is from 4 to 1,000 cP at 25° C., and the viscosity at 5° C. is at least 1.5 times more than that at 25° C., and preferably 1.5 to 50 times.

Further, in the following description, said first coating composition may occasionally be termed Coating Composition 1, while said second coating composition may occasionally be termed Coating Composition 2.

Said first photographic composition layer may be called either a photosensitive layer or an image forming layer, while said second photographic composition layer may be called a protective layer. Other layers may be or may not be placed between said first photographic composition layer and said second photographic composition layer. Listed as examples of other layers are an interlayer for the enhancement of adhesive properties, a protective layer, a second emulsion layer, and the like. Other layers may be or may not be placed between said first photographic composition layer and said support. Listed as examples of other layers are a sublayer, an antihalation layer, and the like. Further, other layers may be or may not be placed on the exterior surface of said second photographic composition layer. Listed as other layers are a second protective lawyer and the like. However, said second layer is preferably an outermost layer.

Thickness of the first layer in the dry state is preferably 0.1 to 30 μm, more preferably 1 to 18 μm. Thickness of the first layer in the wet state at the time of coating is preferably 10 to 200 μm, more preferably 20 to 100 μm. Thickness of the second layer in the dry state is preferably 0.1 to 10 μm, more preferably 0.5 to 7 μm. Thickness of the second layer in the wet state at the time of coating is preferably 10 to 150 μm, more preferably 15 to 100 μm.

It is preferable that said first coating composition and said second coating composition be simultaneously coated so that said first photographic composition layer and said second photographic composition layer are formed. Further, "said first coating composition and said second coating composition be simultaneously coated", as described herein, means that prior to the completion of the drying process of said first coating composition after coating said first coating composition (preferably without passing the drying process for the first coating composition), said second coating composition is coated. Accordingly, "said first coating composition and said second coating composition be simultaneously coated" includes an embodiment in which said first coating composition and said second coating composition are subjected to simultaneous multilayer coating, and an embodiment in which a process for coating said first coating composition and a process for coating said second coating composition are separated, and after coating said first coating composition, said second coating composition is coated, and subsequently, drying is carried out.

The present invention will now be detailed hereunder. It is not preferable that the viscosity of Coating Composition 2 reaches less than 4 cP at 25° C., because, during the preparation of said coating composition, dispersed materials may result in sedimentation when said coating composition is comprised of dispersion. It is also not preferable that the viscosity reach 1,000 cP or higher at 25 ° C., because, during the preparation of said coating composition, it takes time to achieve uniformity while stirring. The viscosity of said coating composition is more preferably from 4 to 500 cp at 25° C., and is still more preferably from 4 to 300 cP. Further, the viscosity of said Coating Composition 2 at 5° C. is generally at least 1.5 times higher than that of said composition at 25° C., is preferably no more than 4 times higher than the same, and is more preferably no more than 3.5 times higher. The viscosity may be measured employing a rotational type, a vibration type, or a thin tube type viscosimeter. The viscosity of the present invention is a value obtained employing a rotational type viscosimeter, and a value determined employing a Brookfield Analogue Viscosimeter.

The polymer latexes, as described in the present invention, refer to hydrophobic polymer particles which are insoluble in water and are dispersed in water-soluble dispersing media. Dispersed states may include any of those in which polymers are emulsified in a dispersion media, or undergo emulsion polymerization or micelle dispersion, or molecular chains themselves are subjected to molecular dispersion, while having partially a hydrophilic structure in polymer molecules. Further, polymer latexes of the present invention are described in "Gosei Jushi Emulsion (Synthetic Resin Emulsions)", edited by Taira Okuda and Hiroshi Inagaki, published by Kobunshi Kankokai (1978), "Gosei Latex no Oyo (Application of Synthetic Latexes), edited by Takaaki Sugimura, Yasuo Kataoka, Soichi Suzuki, and Keiji Kasahara; Soichi Muroi, "Gosei Latex no Kagaku (Chemistry of Synthetic Latexes), published by Kobunshi Kankokai (1970), and others. The average diameter of dispersed particles is preferably in the range of from 1 to 50,000 nm, and is more preferably in the range of from about 5 to about 1,000 nm. The size distribution of the dispersed particles is not particularly limited, and may include both broad size distribution and monodispersed size distribution.

Employed as polymer latexes of the present invention may be so-called core/shell type latexes other than common polymer latexes having a uniform structure. In this case, occasionally, it is preferable that the polymers of core and the shell have different glass transition temperature each other.

The preferred range of the glass transition temperature, Tg, of polymers in the polymer latexes employed in the present invention is different between the layer formed by employing Coating Composition 1 and that formed by employing Coating Composition 2. In the layer formed by employing said Coating Composition 1, in order to promote the diffusion of photographically useful components during heat development, the glass transiting temperature is preferably from −30 to 40° C. On the other hand, when Coating Composition 2 is employed to form a layer which is brought into contact with various devices, the glass transition temperature is preferably from 25 to 70° C.

The lowest film forming temperature (MFT) of polymer latexes of the present invention is preferably from −30 to 90°

C., and is more preferably from about 0 to about 70° C. In order to control the lowest film forming temperature, various film forming aids may be incorporated. Said film forming aids are called temporary plasticizers which are organic compounds (generally, organic solvents) which lower said MTF of polymer latexes. Said aids are described, for example, in the aforementioned Soichi Muroi, "Gosei Latex no Kagaku (Chemistry of Synthetic Latexes)", published by Kobunshi Kankokyokai (1970).

Polymers, which are employed as polymer latexes of the present invention, include vinyl acetate resins, polyester resins, polyurethane resins, rubber based resins, vinyl chloride resins, vinylidene chloride resins, polyolefin resins, and copolymers thereof. Said polymers may include straight chain polymers, branched chain polymers, and bridged polymers. Polymers also include so-called homopolymers prepared by polymerizing the same monomer and copolymers prepared by polymerizing at least two types of monomers. Said copolymers may include random copolymers and block-copolymers. The number average molecular weight of said polymers is commonly from 5,000 to 1,000,000, and is preferably from about 10,000 to about 100,000. Polymers with an excessively small molecular weight are not preferred due to the insufficient mechanical strength of the image forming layer, while those with an excessively large molecular weight are also not preferred due to the degradation of film forming properties.

Specific examples of polymer latexes employed as binders of the image forming layer of the heat developable materials of the present invention include latexes of methyl methacrylate/ethyl acrylate/methacrylic acid copolymers, lattices of methyl methacrylate/2-ethylhexyl acrylate/styrene/acrylic copolymers, latexes of styrene/butadiene/acrylic acid copolymers, latexes of styrene/butadiene/divinylbenzenemethacrylic acid copolymers, lattices of methylmethacrylate/vinyl chloride/acrylic acid copolymers, lattices of vinylidene chloride/ethyl acrylate/acrylonitrile/methacrylic acid copolymers, and the like. Further, such polymers are commercially available. For example, listed as examples of acrylic resins are Sepian A-4635, 46583, and 4601 (manufactured by Daicel Kagaku Kogyo Co., Ltd.), Nipol Lx 811, 814, 821, 820 and 857 (manufactured by Nihon Zeon Co., Ltd.), and the like; as polyester resins are Finetex ES 650, 611, 675, and 850 (manufactured by Dainippon Ink Kagaku Co., Ltd.), WD-size, WMS (manufactured by Eastman Chemical), and the like; as polyurethane resins are Hydran AP 10, 20, 30, and 40 (manufactured by Dainippon Ink Kagaku Co., Ltd.), and the like; as rubber based resins are Lacstar 7310K, 3307B, 4700H, 7132C (manufactured by Dainippon Ink Kagaku Co., Ltd.), Nipol Lx 416, 410, 438C, and 2507 (manufactured by Nippon Zeon Co., Ltd.), and the like; as vinyl chloride resins are G 351 and G 576 (manufactured by Nihon Zeon Co., Ltd.), and the like; as vinylidene chloride resins are L 502 and L 513 (manufactured by Asahi Kasei Kogyo Co., Ltd.), Aron D 7020, D 504, and D 5071 (manufactured by Mitsui Toatsu Co., Ltd.), and the like; as olefin resins are Chemipearl S 120 and SA 100 (manufactured by Mitsui Sekiyu Kagaku Ltd.) and the like. If desired, said polymers may be employed in combination of two or more types upon blending.

The photographic constitution layer of the present invention is prepared by coating and drying a water based coating composition. "Water based" as described herein means that the solvent (a dispersion medium) of said coating composition is water in an amount of at least 60 percent by weight. As components other than water in the solvents of said coating composition, it is possible to employ water-miscible organic solvents such as methyl alcohol, ethyl alcohol, isopropyl alcohol, methyl cellosolve, ethyl cellosolve, dimethylformamide, ethyl acetate, and the like. Examples of specific solvent compositions other than water include water/methanol=90/10, water/methanol=70/30, water/ethanol=90/10, water/isopropanol=90/10, water/dimethylformamide=95/5, water/methanol/dimethylformamide=80/15/5, water/methanol/dimethylformamide=90/5/5 (figures express percent by weight).

The amount of total binders of the photographic constitution layer of the present invention is preferably in the range of from 0.2 to 30 g/m$^2$, and is more preferably in the range of from 1 to 15 g/m$^2$. Crosslinking agents for bridging, as well as surface active agents for improving coatability, may be incorporated into said photographic constitution layer of the present invention.

Further, the first coating composition as well as the second coating composition preferably comprises phthalazine derivatives.

Phthalazine derivatives, employed in the present invention, are expressed by General Formula (1), described hereunder.

General Formula (1)

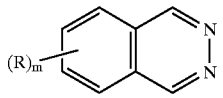

In General Formula (1), R represents an alkyl group, and "m" represents an integer of 1 to 4. When m≧2, a plurality of R may be the same or different.

Preferred examples of the alkyl groups represented by R include those preferably having 1 to 8 carbon atoms, and more preferably having 1 to 5 carbon atoms. For example, listed are methyl, ethyl, n-propyl, iso-propyl, n-butyl, iso-butyl, tert-butyl, tert-amyl, and n-octyl. "m" represents an integer of 1 to 4. When m IS two or more, a plurality of R may be the same or different. Of combinations of those alkyl groups, compounds having a melting point of no more than 130° C. are preferred. Such compounds include those in a liquid state at normal temperature (about 15° C.).

Compounds having a melting point of no more than 130° C., which are represented by General Formula (1), are exemplified hereunder. However, the present invention is not limited to these compounds.

1-1

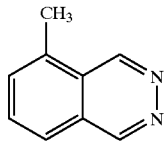

(Melting point of 72 to 74° C.)

1-2

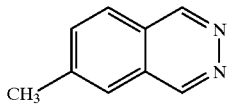

(Melting point of 55° C.)

-continued 1-3

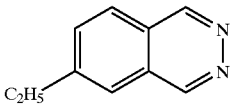

(Melting point of 29 to 30° C.)

1-4

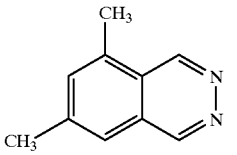

(Melting point of 107 to 108° C.)

1-5

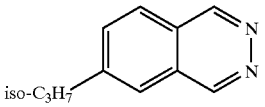

(Melting point of 46 to 49° C.)

1-6

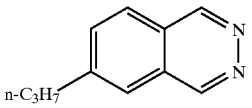

(Liquid at normal temperature)

1-7

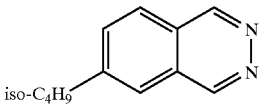

(Melting point of 29 to 30° C.)

1-8

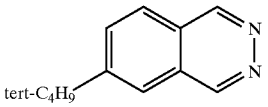

(Melting point of 121 to 124° C.)

1-9

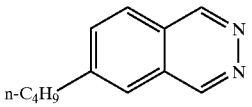

(Liquid at normal temperature)

1-10

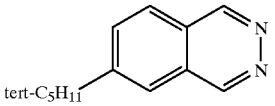

(Melting point of 102 to 104° C.)

The coating speed in the present invention is preferably from 50 to 400 m/minute, and is more preferably from 80 to 250 m/minute. When said coating speed is at least 50 m/minute, the silver image color as well as the linearity is acceptable. The reason for this is not definitely understood. However, it is assumed that when a coating composition is applied onto the support which is conveyed in the range of the above speed, said coating composition rapidly spreads out so that needle shaped organic silver particles are aligned. Said coating speed of no more than 400 m/minute is preferred so that more uniform coating can be achieved.

Incidentally, said coating speed is preferably applied to the second coating composition, and is more preferably applied to the first coating composition as well as the second coating composition.

The drying process, as described herein, refers to a process immediately after the coating composition is coated (when coated, said support comes into contact with the conveying rollers) until the moisture content (which is the percent by weight of water with respect to the weight of solids coated onto the support, which is measured at 23° C. and 20 percent relative humidity) reaches 20 percent. By incorporating thickeners into Coating Composition 2, it is possible to obtain the suitable viscosity of the coating composition.

Further, the second coating composition preferably comprises viscosity increasing agents.

Thickeners, as described herein, refer to those which are soluble in water or are dispersed into water, and have a viscosity of from 10 to 100,000 cP at 25° C. of those solutions at a concentration of 20 percent by weight or those dispersions at the same concentration and also have a viscosity at 5° C. which is 1.5 times higher than that at 25° C. Said thickeners include polymer polysaccharides. Preferred materials include gelatin, guar gum, casein, pectin, sodium cellulose glycolate, sodium alginate, sodium polyacrylate, agar, carrageenan, gluten, xanthane, methyl cellulose, locust bean gum, galactan, konjakmannan, and the like. Of these, more preferred are xanthane, locust bean gum, carrageenan, and konjakmannan. Further, polyvinyl alcohols are also preferably employed.

In order to promote an increase in viscosity, boric acid salts are preferably added. Specifically, preferred boric acid salts include alkaline earth metal borates, ammonium borates, and amine borates. For example, preferred are ammonium borate, calcium borate, sodium metaborate, sodium tetraborate, and hydrogen methyl ammonium tetraborate. Boric acid and borax are preferably added to polyvinyl alcohols.

Preferred inorganic thickeners include colloidal aluminum silicate, and those represented by the general formula described below are preferred.

$$(X, Y)2\text{-}3(Si, Al)_4O_{10}(OH)_2Z_{1/3}\cdot nH_2O$$

wherein X represents A1, Fe(III), Mn(III), or Cr(III), Y represents Mg, Fe(II), Ni, Zn, Li, or Mn(II), and Z represents K, Na, ½Ca, or ½Mg. Specific examples include natural or synthetic (in this case, the OH group of the above formula is substituted by fluorine) a series of montmorillonites such as montmorillonite, saponite, hectorite, and the like (commercially available products include Bee Gum, Kunipia, Raponite, and the like) and synthetic mica known as sodium silyric mica, sodium or lithium teniorite (commercially available products include Dymonite manufactured by TOPY INDUSTRIES, LTD.). However, bentonite as well as synthetic mica is not so preferred due to small effects.

In order to promote an increase of viscosity by employing inorganic thickeners, it is preferred to add fatty acids or quaternary ammonium salts, which specifically include oleic acid, lauric acid, myristic acid, palmitic acid, stearic acid, isostearic acid, linoleic acid, linolenic acid, eicosapentaenoic acid, docosahexenoic acid, behenic acid, 12-hydroxystearic acid, undecylic acid, toleic acid, and the like.

Listed as quaternary ammonium salts may be those represented by General Formula (2), described hereunder.

General Formula (2)

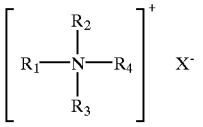

wherein $R_1$ represents an alkyl group having from 10 to 22 carbon atoms or a benzyl group, $R_2$ represents a methyl group or an alkyl group having from 10 to 22 atoms, $R_3$ and $R_4$ each represent an alkyl group having from 1 to 3 carbon atoms or a methylsulfate residual group.

Specific examples include dodecylmethylammonium chloride, myristyltrimethylammoniun chloride, cetyltrimethylammonium chloride, atearyltrimethylammonium chloride, aralkyltrimethylammonium chloride, behenyltrimethylammonium chloride, myristyldimethylethylammonium chloride, cetyldimethylethylammonium chloride, stearyldimethylethylammonium chloride, aralkyldimethylethylammonium chloride, behenyldimethylethylammonium chloride, myristyldiethylmethylammonium chloride, cetyldiethylmethylammonium chloride, stearyldiethylmethylammonium chloride, aralkyldiethylmethylammonium chloride, behenyldiethylmethylammonium chloride, benzyldiethylmethylammonium chloride, benzyldimethylcetylammonium chloride, benzyldimethylstearylammonium chloride, benzyldimethylbehenylammonium chloride, benzylmethylethylcetylammonium chloride, benzylmethylethylstearylammonium chloride, dibehenyldihydroxyethylammonium chloride, and corresponding bromides, and in addition, dipalmitylpropylethylammonium methylsulfate, and the like.

Upon realizing the present invention, one type or at least two types are optionally selected from those. The second coating composition is preferably gelled at a temperature, which is at least 15° C. lower than the temperature of said second coating composition during coating. Due to that, said second coating composition preferably comprises gelation enhancing agents. Gel promoting agents, as described in the present invention, refers to those which promote gelling of Coating Composition 2 at temperatures which is at least 15° C. lower than the coating temperature, and include said compounds which promote an increase in viscosity. Gelling as described in the present invention refers to the change into a jelly-like solidified state, and exhibit at least variations of physical quality described hereunder:

1) when gelling occurs, the cooling curve exhibits a sharp turning point.
2) the intensity of scattered light suddenly increases, or
3) variations of mechanical quality, especially such as an abrupt increase in elastic modulus, rigidity, and the like, occur. Examples of the gelation promoting agent include those exemplified as the thickening agent as far as they satisfy the condition mentioned above. Content of the thickening ragnent and gelation promoting agent is preferably from 0.5 to 30 weight %, more preferably from 1 to 20 weight % and in particular from 2 to 15 weight % with reference to the amount of a solvent.

Employed as organic silver salts, photosensitive silver halides, reducing agents, sensitizing dyes, and other various additives may be those described in Japanese Patent Publication Open to Public Inspection Nos. 11-282124, 2000-98534, and others.

For example, organic silver salts are reducible sliver sources, and are preferably silver salts of organic acids and heterorganic acids comprising reducible silver ion sources, especially aliphatic carboxylic acids having a long chain (having from 10 to 30 carbon atoms, and preferably from 15 to 25 carbon atoms) and nitrogen containing heterocyclic rings. Inorganic or organic silver salt complexes having ligands with a general stability constant to silver ions of from 4.0 to 10.0 are useful. Examples of suitable silver salts are described in Research Disclosures 17029 and 29963. Specifically preferred organic silver salts are any of silver behenate, silver arachidiate, and silver stearate. The average grain diameter of organic silver grains is preferably from 0.2 to 1.2 $\mu$m, and is more preferably from 0.35 to 1 $\mu$m. Further, organic silver grains are preferably monodispersed, and preferably have the degree of monodispersion of from 1 to 30 which is obtained based on the formula described blow.

Degree of monodispersion=[(standard deviation of grain size)/(average of grain diameter)]×100

Content of the organic silver salt is preferably from 0.1 to 10 g/m$^2$, more prefereably from 0.5 to 5 g/m$^2$,in particular from 0.8 to 3 g/m$^2$. Further, silver halides includes any of silver chloride, silver chlorobromide, silver chloroiodide, silver bromide, silver iodobromide, and silver iodide. The average grain size is preferably no more than 0.1 $\mu$m, is more preferably from 0.01 to 0.1 $\mu$m, and is further more preferably from 0.02 to 0.08 $\mu$m. The degree of monodispersion of silver halides is preferably no more than 40, is more preferably no more than 30, and is further more preferably no more than 30, and is still further preferably from 0.1 to 20.

Content of the silver halide is preferably from 0.5 to 20%, more preferably 1 to 10% and particularly preferably from 2 to 7 weight % by weight, in terms of molar ratio of the organic silver salt to the silver halide (silver halide/organic silver salt).

Further, examples of suitable reducing agents are described in U.S. Pat. Nos. 3,770,448, 3,773,512, and others. Specifically preferred reducing agents are hindered phenols. Content of the reducing agent is preferably from 0.1 to 2 mols and more preferably 0.1 to 1 mol with reference to 1 mol of silver (sum of the organic silver salt and silver halide).

In the present invention, employed may be contrast increasing agents along with other additives. Specific compounds include compounds represented by General Formulas (1), (2), and (3) of Japanese Patent Publication Open to Public Inspection No. 2000-35630, as well as hydrazine compounds described in paragraphs numbered from 0154 to 0161 of Japanese Patent Publication Open to Public Inspection 11-218877. The content of the contrast increasing agent is preferably from 0.001 to 1 mol, more preferably from 0.005 to 0.5 mol, and partiularly preferably from 0.01 to 0.4 mol with reference to 1 mol of silver.

Heat developable photosensitive materials of the present invention are produced employing the methods described hereunder.

1. A method for producing a heat developable photosensitive material which is prepared by simultaneously coating a support with Coating Composition 1 which comprises a polymer latex in an amount of at least 30 percent by weight of a photographic constitution layer which is formed by said Coating Composition 1 comprising at least an organic silver salt, photosensitive silver halide, and a reducing agent, and which also comprises water in an amount of at least 50 percent by weight of the solvent, and Coating Composition 2 which comprises a polymer latex in an amount of at least 50 percent of a photographic constitution layer formed by employing said Coating Composition 2, comprises water in an amount of at least 60 percent by weight of the solvent, has a viscosity of from 50 to 1,000 cP at 25° C., and also has a viscosity at 5° C. which is at least 1.5 times higher than that at 25° C. so that said Coating Composition 2 is coated on said Coating Composition 1 on said support.

2. The method for producing a heat developable photosensitive material described in 1. above wherein the photographic constitution layer prepared by employing said Coating Composition 2 is the uppermost layer with respect to said support.
3. The method for producing a heat developable photosensitive material described in 1. above wherein the polymer layer of said Coating Composition 2 has a glass transition point of from 25 to 70° C.
4. The method for producing a heat developable photosensitive material described in 1., 2. or 3. above wherein a phthalazine derivative is incorporated into either said Coating Composition 1 or said Coating Composition 2.
5. The method for producing a heat developable photosensitive material described in any one of 1. through 4. above wherein said material is prepared employing a coating speed of from 50 to 400 m/minute.
6. The method for producing a heat developable photosensitive martial described in 5. above wherein said material is prepared employing the drying process after said coating in which drying is carried out so that said material is not brought into contact with the conveying rollers.
7. A method for producing a heat developable photosensitive material which is prepared by simultaneously coating onto a support with Coating Composition 1, which comprises a polymer latex in an amount of at least 30 percent by weight of a photographic constitution layer which is formed by employing said Coating Composition 1, comprising at least an organic silver salt, photosensitive silver halide, and a reducing agent, and which also comprises water in an amount of at least 50 percent by weight of the solvent, and Coating Composition 2, which comprises a polymer latex in an amount of at least 50 percent of a photographic constitution layer formed by employing said Coating Composition 2, also comprises a thickener, comprises water in an amount of at least 60 percent by weight of the solvent, and has a viscosity of from 50 to 1,000 cP at 25° C. so that said Coating Composition 2 is coated on said Coating Composition 1 on said support.
8. The method for producing a heat developable photosensitive material described in 7. above wherein said thickener is gelled at a temperature of 15° C. lower than the temperature during the coating of said Coating Composition 2.
9. The method for producing a heat developable photosensitive material described in 7. or 8. above wherein said Coating Composition 2 comprises a gel promoting agent.
10. A method for producing a heat developable photosensitive material which is prepared by simultaneously coating onto a support with Coating Composition 1, which comprises a polymer latex in an amount of at least 30 percent by weight of a photographic constitution layer which is formed by employing said Coating Composition 1, comprising at least an organic silver salt, photosensitive silver halide, and a reducing agent, and which also comprises water in an amount of at least 60 percent by weight of the solvent, and Coating Composition 2, which comprises a polymer latex in an amount of at least 50 percent of a photographic constitution layer formed by employing said Coating Composition 2, also comprises water in an amount of at least 60 percent by weight of the solvent, and is gelled at a temperature which is at least 15° C. lower than the temperature at coating so that said Coating Composition 2 is coated on said Coating Composition 1 on said support.
11. The method for producing a heat developable photosensitive material described in 10. above wherein said Coating Composition 2 comprises a gel promoting agent.

EXAMPLES

The present invention will now be described with reference to the examples.

Incidentally, in the examples described below, the emulsion layer is a first (photographic composition) layer and the emulsion surface protecting layer is a second (photographic composition) layer. Further, the emulsion layer coating composition is a first coating composition, while the emulsion surface protecting coating composition is a second coating composition.

Example 1

(Preparation of Silver Halide Grains A)

Dissolved in 650 ml of water were 11 g of phthalated gelatin, 30 mg of potassium bromide, and 10 mg of sodium benzenethiosulfonate, and the pH of the resulting solution was adjusted to 5.0 at 55° C. Afterward, 150 ml of an aqueous solution containing 18.6 g of silver nitrate and an aqueous solution of potassium bromide were added over 6 minutes 30 seconds employing a double jet method while maintaining the pAg at 7.7. Subsequently, 476 ml of an aqueous solution containing 55.5 g of silver nitrate and an aqueous potassium bromide were added over 28 minutes 30 seconds employing a double jet method, while maintaining the pAg at 7.7. Thereafter, the pH was lowered and the resulting mixture was desalted employing a coagulation process. Then 0.17 g of Compound A, described below, and 23.7 g of deionized gelatin (with no more than 20 ppm as the calcium content), and the pH and the pAg were adjusted to 5.9 and 8.0, respectively.

Obtained were cubic grains having an average grain size of 0.11 $\mu$m (the projected area diameter), a variation coefficient of the projected area diameter) of 8 percent, and a (100) plain ratio of 93 percent.

Said obtained grains, as previously described, were heated to 60° C., and 76 micromoles of sodium benzenethiosulfonate per mole of silver was added. After 3 minutes, 154 micromoles of sodium thiosulfate were added, and ripening was carried out for 100 minutes.

Thereafter, the temperature was maintained at 40 0C., and $6.4\times10^{-4}$ mole of Sensitizing Dye A, described below, and $6.4\times10^{-3}$ mole of Compound B, described below, per mole of silver halide were added while stirring. After 20 minutes, the temperature was rapidly decreased to 30° C., and the preparation of Silver Halide Grains A was completed.

Sensitizing Dye A

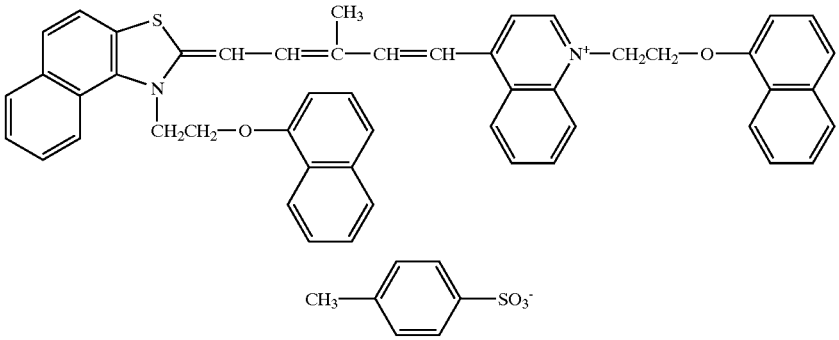

Compound A

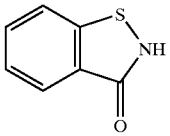

Compound B

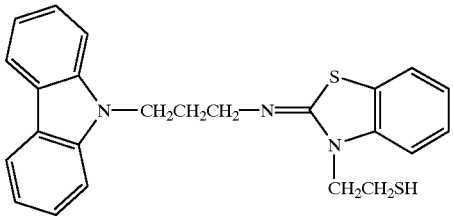

(Preparation of the Organic Acid Silver Dispersion)

While stirring at 85 0C., added to a mixture of 4.4 g of arachidic acid, 39.4 g of behenic acid, and 770 ml of distilled water were 103 ml of an aqueous NaOH solution at a concentration of 1 mole/liter over 60 minutes, and the resultant mixture underwent reaction for 240 minutes and was cooled to 30° C. Thereafter, the resulting solids were separated employing absorption filtration and were washed until the electrical conductivity of the wash water of said solids reached 30 $\mu$S/cm.

Solids obtained as above were not dried but handled as a wet cake. Then added to said wet cake in an amount corresponding to 100 g of dried solids were 10 g of polyvinyl alcohol (PVA-205, manufactured by Kuraray Co., Ltd.) and water. The total volume was then adjusted to 500 g and was then subjected to preliminary dispersion employing a homomixer.

Subsequently, said preliminary dispersed composition, without any modification, was subjected to three treatments under an adjusted pressure of 1,750 kg/cm$^2$ employing a homogenizer (under the trade name of Microfluidizer M-11 OS-EH, manufactured by Microfluidex International Corporation, utilizing G1Z Interaction Chamber) . The preparation was finalized upon obtaining fine organic acid silver crystals with a volume weighted average diameter of 0.93 $\mu$m. The grain size was determined employing a Master Sizer X manufactured by Malvern Instruments Ltd. Cooling operation was carried out in such a manner that coiled heat exchangers were mounted on the front as well as the rear of the interaction chamber and desired dispersion temperature was set by controlling the temperature of refrigerants.

(Preparation of Fine Solid Particle Dispersion of 1,1-bis(2-hydroxy-3, 5-dimethylphenyl)-3, 5, 5-trimethylhexane)

Added to 20 g of 1,1-bis(2-hydroxy-3,5-dimethylphenyl)-3, 5,5-trimethylhexane were 3.0 g of MP 203 of MP Polymer manufactured by Kuraray Co., Ltd. and 77 ml of water. The resulting mixture was then well stirred to form a slurry which was set aside for 3 hours. Afterward, 360 g of 0.5 mm zirconia bead were prepared and placed into a vessel together with said slurry, and the resulting mixture was dispersed for 3 hours employing a homogenizer (¼G Sand Grinder Mill, manufactured by Imex Co., Ltd.) to prepare a fine reducing agent solid particle dispersion. The particle diameter of 80 percent by weight of particles was from 0.3 $\mu$m to 1.0 $\mu$m.

(Preparation of Fine Solid Particles of Tribromomethylphenylsulfone)

Added to 30 g of tribromomethylphenylsulfone were 0.5 g of hydroxypropyl methyl cellulose, 0.5 g of Compound C, and 88.5 g of water. The resulting mixture was then well stirred to form a slurry which was set aside for 3 hours. Fine antifoggant solid particles were prepared in the same manner as said reducing agent solid dispersion. The particle diameter of 80 percent by weight of said particles was from 0.3 $\mu$m to 1.0 $\mu$m.

(Preparation of Emulsion Layer Coating Composition)

As described below, the amount of the binder, components, and Silver Halide Particles A described below per mole of the fine organic silver crystal dispersion were added. Further, an emulsion layer coating composition was prepared by adding water so as to obtain a wet layer thickness of 60 $\mu$m during coating.

| | |
|---|---|
| Binder, Lacstar 3307B (SBR latex having a glass transition temperature of 17° C., manufactured by Dainippon Ink Kagaku Kogyo Co., Ltd.) as solids | 470 g |
| 1,1-Bis (2-hydroxy-3,5-dimethylphenyl)-3,5,5-trimethylhexane as solids (reducing agent) | 110 g |
| Tribromomethylphenylsulfone as solids | 25 g |
| Sodium benzenethiosulfonate | 0.25 g |
| Polyvinyl alcohol (MP-203, manufactured by Kuraray Co., Ltd.) | 46 g |
| Phthalazine | 0.12 mole |
| Dye A | 0.62 g |
| Silver Halide Particles A as Ag amount | 0.05 mole |

Compound C

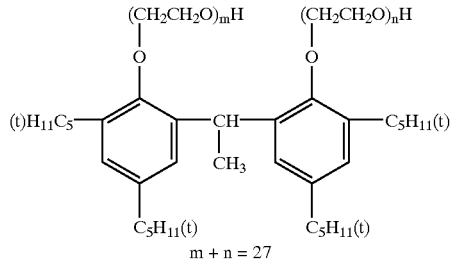

Dye A

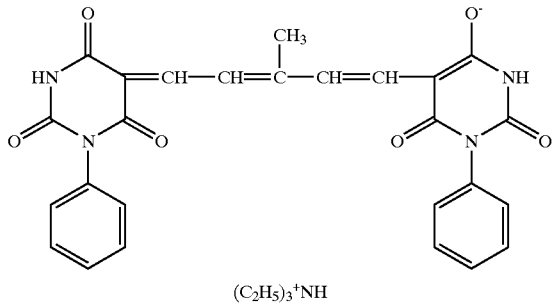

(Preparation of PET Support with Backing Layer/Sublayer (1) Support

Based on a conventional method, PET (with an intrinsic viscosity, IV, of 0.66 (phenol/tetrachloroethane=6/4 at a weight ratio) measured at 25° C.) was prepared, employing terephthalic acid as well as ethylene glycol. After pelletizing the obtained PET, bluing dyes were added to obtain a transmission density of 0.17 after casting. After drying the resulting mixture at 130° C. for 4 hours, it was fused at 300° C., and then extruded from a T type die, and subsequently cooled rapidly, whereby an unstretched film was prepared.

The resulting film was longitudinally stretched by a factor of 3.3 utilizing rolls at different circumferential speed, and subsequently stretched laterally by a factor of 4.5 utilizing a tenter. Temperatures during stretching were 110° C. and 130° C., respectively. Afterward, the resulting film was subjected to thermal fixation at 240° C. for 20 seconds, and then subjected to 4 percent relaxation in the lateral direction at the same temperature. Thereafter, after removing the resulting chucked portion of the tenter through slitting, both edges were subjected to a knurling treatment and the resulting film was wound under a tension of 4.8 kg/cm$^2$. In such manner as above, a 175 $\mu$m thick blue tinted film roll of 2.4 m width and 3,500 m length was obtained.

(2) Sublayer

Coating Composition of Sublayer (a)

| | |
|---|---|
| Polymer Latex 1<br>Styrene/butadiene/hydroxyethyl methacrylate/divinylbenzene = 67/30/2.5/0.5 (in percent by weight) | 160 mg/m$^2$ |
| 2,4-Dichloro-6-hydroxy-s-triazine | 4 mg/m$^2$ |
| Matting agent (polystyrene, having an average particle diameter of 2.4 $\mu$m) | 3 mg/m$^2$ |

(3) Electrically Conductive Layer Coating Composition

| | |
|---|---|
| Jurimer ET-410 (manufactured by Nippon Junyaku Co., Ltd.) | 38 mg/m$^2$ |
| $SnO_2$/Sb (at a weight ratio of 9/1, and with an average particle diameter of 0.25 $\mu$m) | 120 mg/m$^2$ |
| Matting agent (polymethyl methacrylate, with an average particle diameter of 5 $\mu$m) | 7 mg/m$^2$ |
| Melamine | 13 mg/m$^2$ |

(4) Backing Layer Coating Composition

Added to 10 g of a polymer latex of 27.5 percent solids (a copolymer of methyl methacrylate/styrene/2-ethylhexyl acrylate/2-hydroxyethyl methacrylate/methacrylic acid= 59/9/26/5/1, having a glass transition point of 55° C.), were 3.75 g of water and Dye A in an amount which resulted in an optical density of 0.8, 4.5 g of benzyl alcohol as the film forming agent, 0.45 g of Compound D, 0.125 g of Compound E, and 2.25 g of polyvinyl alcohol (PVA-217, manufactured by Kuraray Co., Ltd.). Further, water was added so as to obtain a wet thickness of 60 $\mu$m during coating, whereby a coating composition was prepared.

(5) Protective Layer Coating Composition

| | |
|---|---|
| Polymer latex of 27.5 percent solids (copolymer of methyl methacrylate/styrene/ 2-ethylhexyl acrylate/2-hydroxyethyl methacrylate/ methacrylic acid = 59/9/26/5/1, having a glass transition point of 55° C.) as solids | 3 g/m$^2$ |
| Chemipearl S-120 (manufactured by Mitsui Sekiyu Kagaku Co., Ltd.) | 500 mg/m$^2$ |
| Snowtex-C (manufactured by Nissan Kagaku Co., Ltd.) | 40 mg/m$^2$ |
| Denacol EX-614B (manufactured by Nagase Kasei Kogyo Co., Ltd.) | 30 mg/m$^2$ |

Water in an amount to obtain a wet thickness of 10 $\mu$m

Sublayer (a) was applied onto both surfaces of said support and an Electrically Conductive Layer was coated on one side of the support successively, and subsequently dried at 180° C. for 4 minutes. Afterward, said Backing Layer Coating Composition and said Protective Layer Coating Composition were applied onto the electrically conductive layer and subsequently dried, whereby a PET support with a backing layer/sublayer was prepared. The drying conditions during said process are shown in FIG. 1. Incidentally, the coating speed was set at 30 m/minute. The wet layer thickness of the backing layer and the protective layer was set at 60 $\mu$m and 10 $\mu$m, respectively. As shown in FIG. 1, air was blown from minute holes of the surface of all conveying rollers so that photosensitive materials were not brought into contact with the conveying rollers during coating. In FIG. 1, DB represents dry bulb temperature, WB represents wet bulb temperature, and RH represents relative humidity.

The PET support, prepared as previously described, was placed in a 30 m long heat treatment zone set at 160° C. and was conveyed under a tension of 14 g/cm$^2$ at a conveying speed of 20 m/minute. Thereafter, said support passed through a 40 ° C. zone for 15 seconds and then wound under a winding tension of 10 kg/cm2.

(Preparation of Emulsion Surface Protecting Layer Coating Composition)

Added to 109 g of a polymer latex of 27.5 percent solids (a copolymer of methyl methacrylate/styrene/2-ethylhexyl acrylate/2-hydroxyethyl methacrylate/methacrylic acid =59/9/26/5/1, having a glass transition point of 55 °C.), were 3.75 g of $H_2O$, 4. 5 g of benzyl alcohol as the film forming agent, 0.45 g of Compound D, 0.125 g of Compound E, 0.0125 mole of 4-methylphthalic acid, and 2.25 g of polyvinyl alcohol (PVA-217, manufactured by Kuraray Co., Ltd.). Further, $H_2O$ was added so as to obtain a total weight of 150 g. Subsequently, by adding the compounds shown in Table 1, coating compositions were prepared so that the viscosity of each said coating compositions at 25° C. reached the value shown in Table 1.

Compound D

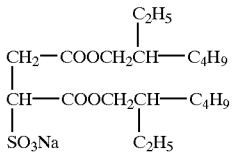

Compound E

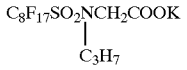

(Preparation of Heat Developable Photosensitive Materials)

Said Emulsion Layer Coating Composition was applied onto the sublayer of the PET support with a backing layer/sublayer, so as to obtain a coated silver weight of 1.6 g/m$^2$. Further, said Emulsion Surface Protecting Layer Coating Composition was applied on the resulting layer so as to obtained a coated weight of solids of said polymer latex of 2.0 g/m$^2$, whereby Heat Developable Photosensitive Materials 1 through 25 were prepared. The wet layer thickness of said Emulsion Layer Coating Composition was 60 $\mu$m during coating, while the wet layer thickness of said Emulsion Surface Protecting Layer Coating Composing was 12 $\mu$m during coating. FIG. 1 shows a schematic cross-sectional view of the drying process as well as conditions during coating. Coating was carried out so that the coating speed of the emulsion surface side reached 100 m/minute.

Each of coated photosensitive materials was cut to 345 ×430 mm under an atmosphere of 23° C. and 50 percent relative humidity. In the Example water content of solvent in the coating composition of the emulsion layer is 70% by weight, and the content of the polymer latex is 40% by weight. Water content of solvent in the coating composition of the protective layer for the emulsion layer is 70% by weight, and the content of the polymer latex is 60% by weight.

Evaluation Methods

Measurement of Viscosity

Viscosity was measured employing an E Type Viscosimeter (being a rotating viscosimeter) of Toki Sangyo.

Uneven Density

Scanning exposure was applied onto each emulsion surface of said photosensitive materials cut to 345×430 mm, employing an exposure unit in which a semiconductor laser, which was subjected to longitudinal multimode wavelengths of 800 nm to 820 nm by high frequency superimposition, was utilized a beam source for exposure. During exposure, images were formed while adjusting the angle, between the exposure surface of said photosensitive material and the laser beam for exposure, to 75 degrees. The exposure amount was set so that the density after development was in the range of 1.5 to 2.0.

Afterward, each of said exposed materials was subjected to heat development at 120° C. for 15 seconds, employing an automatic development unit, having a heating drum, so that the protective layer of said material was brought into contact with said drum surface. Uneven density was visually evaluated based on a 10-rank criterion. Rank "10" was at a level in which uneven density was not noticed at all. Rank "8" was at a level in which slight uneven density was noticed when the sample was subjected to slight movement on a viewing box, but resulted in no problem for commercial viability. Rank "5" was at a level in which uneven density was clearly noticed and was within the lower limit of commercial viability. Rank "3" was at a level of no commercial viability in the degree that at least 50 percent of the customers would complain uneven density.

Fingerprints

Before exposure, under an atmosphere of 23° C. and a relative humidity of 50 percent, the index finger area was brought into close contact with commercially available wet tissue, and subsequently, said finger was rapidly brought into contact with 10 different areas of the emulsion side surface of each sample (the contact of the index finger with said wet tissue occurred only once). Thereafter, said sample was exposed so that the density after development was in the range of 2.0 to 2.5 and was subjected to heat development at 120° C. for 15 seconds, employing an automatic development unit having a heating drum, so that the protective layer of said sample was brought into contact with said drum surface. The frequency of finger contact, which resulted in a decrease in density due to resulting fingerprints, was evaluated. Evaluation was carried out based on a 10-rank criterion. Rank "10" was at a level in which said fingerprints were not at all noticed. Rank "8" was at a level in which the fingerprints were noticed on the first and second contact, and Rank "5" was at a level in which the fingerprints were noticed through the 5th contact.

Image Color

For evaluating silver image color, exposed and developed samples were prepared so that the density after development reached 1.1±0.05. Each of the obtained samples was irradiated with light having a color temperature of 7,700 Kelvin and an illuminance of 11,600 lux for 100 hours and the silver image color was evaluated based on the criteria described below. The rank of 7 or higher was considered as no problem to assure the quality.

Evaluation Criteria

10: pure black and no yellow was noticed
8: not pure black, and almost no yellow was noticed
7: very slight yellow was noticed
6: slight yellow was noticed bout 30 percent area of the the sample
5: yellow was slightly noticed on about 50 percent area of the sample
3: yellow was noticed over the entire area
1: yellow was readily notice.

TABLE 1

| Sample No. | Thickener | Viscosity of Coating Composition (in cP) 25° C. (a) | 5° C. (b) | Viscosity Ratio b/a | Uneven Density Rank | Finger-print Rank | Image Color Rank | Remarks |
|---|---|---|---|---|---|---|---|---|
| 1 | — | 8 | 11 | 1.4 | 4 | 6 | 5 | Comp. |
| 2 | — | 10 | 14 | 1.4 | 4 | 6 | 5 | Comp. |
| 3 | Gelatin | 8 | 12 | 1.5 | 6 | 6 | 7 | Inv. |
| 4 | Gelatin | 10 | 20 | 2.0 | 6 | 6 | 7 | Inv. |
| 5 | Locust bean gum | 8 | 12 | 1.5 | 7 | 6 | 7 | Inv. |
| 6 | Locust bean gum | 10 | 18 | 1.8 | 7 | 7 | 8 | Inv. |
| 7 | Locust bean gum | 20 | 30 | 1.5 | 7 | 7 | 8 | Inv. |
| 8 | Locust bean gum | 500 | 1000 | 2.0 | 7 | 7 | 8 | Inv. |
| 9 | Locust bean gum | 600 | 2000 | 3.3 | 7 | 6 | 6 | Inv. |
| 10 | Sodium polyacrylate | 12 | 18 | 1.5 | 7 | 7 | 8 | Inv. |
| 11 | Guar gum | 13 | 20 | 1.5 | 7 | 7 | 8 | Inv. |
| 12 | Agar | 10 | 22 | 2.2 | 7 | 7 | 8 | Inv. |
| 13 | Sodium alginate | 14 | 30 | 2.1 | 7 | 7 | 7 | Inv. |
| 14 | Casein | 12 | 20 | 1.7 | 7 | 7 | 7 | Inv. |
| 15 | Xanthane | 13 | 22 | 1.7 | 7 | 7 | 8 | Inv. |
| 16 | Carrageenan | 12 | 30 | 2.5 | 7 | 7 | 8 | Inv. |
| 17 | Konjakmannan | 14 | 40 | 2.9 | 7 | 7 | 8 | Inv. |
| 18 | Lithium teniorite | 35 | 70 | 2.0 | 7 | 8 | 7 | Inv. |
| 19 | Saponite | 30 | 65 | 2.2 | 7 | 8 | 7 | Inv. |
| 20 | Hectorite | 34 | 60 | 1.8 | 7 | 8 | 7 | Inv. |
| 21 | Saponite | 33 | 60 | 1.8 | 7 | 8 | 7 | Inv. |
| 22 | Saponite/Behenic acid | 35 | 80 | 2.3 | 8 | 8 | 8 | Inv. |
| 23 | Saponite/Stearic acid | 33 | 78 | 2.4 | 8 | 8 | 7 | Inv. |
| 24 | Saponite/Lauric acid | 30 | 74 | 2.5 | 8 | 8 | 8 | Inv. |
| 25 | Locust bean gum & Sodium metaborate | 34 | 70 | 2.1 | 8 | 8 | 7 | Inv. |
| 26 | Polyvinyl alcohol, Boric acid, & Borax | 25 | 50 | 2.0 | 8 | 8 | 7 | Inv. |

Based on Table 1, it is found that in the constitution of the present invention, uneven density, as well as fingerprints are minimized and silver image color is improved.

Example 2

Samples were prepared in the same manner as Example 1 except that the contents as described below were varied. (1) Added to Emulsion Layer Coating Composition were added 2.0 g of Contrast Increasing Agent H-1 and 1.0 g of Contrast Increasing Agent H-2.

H-1

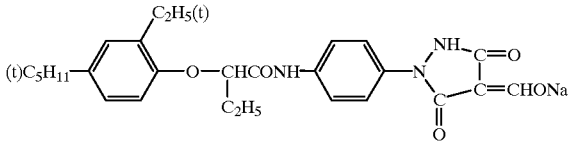

H-2

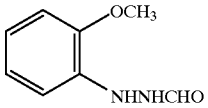

(2) An unstretched film was prepared in the same manner as Example 1, except that bluing dyes were not incorporated. The resulting unstretched film was longitudinally stretched by a factor of 3.3 utilizing rolls of different circumferential speed, and subsequently stretched laterally by a factor of 4.5 utilizing a tenter. Temperatures during stretching were 110° C. and 130° C., respectively. Afterward, the resulting film was subjected to thermal fixation at 240° C. for 20 seconds, and then subjected to 4 percent relaxation in the lateral direction at the same temperature. Thereafter, after removing the resulting chucked portion of the tenter employing slitting, both edges were subjected to a knurling treatment and the resulting film was wound under a tension of 4.8 kg/cm$^2$. In a manner such as above, a 120 $\mu$m thick film roll of 2.4 m width and 3,500 m length was obtained, which was subsequently employed as a support.

(3) The emulsion surface-protecting layer coating composition was prepared in the same manner as Example 1, except that each of the compounds shown in Table 2 was added in an amount so that the viscosity of each coating composition reached the value shown in Table 2.

(4) In the preparation of said heat developable photosensitive materials, they were finished in the form of 458 mm×40 m rolls. Said photosensitive material was wound on a 3-inch paper core under an atmosphere of 23° C. and 50 percent relative humidity. Said paper core was set aside in an atmosphere of 50° C. and 5 percent relative humidity for 48 hours, and was then employed.

Evaluation Methods

Linearity

Said roll sample was mounted on an Image Setter ECRM Mako 4650, and an image, which theoretically consisted of 10 percent halftone dots,was exposed without correction for linearity under exposure condition in which halftone dots which theoretically cosisted of 90 percent exhibited 90 percent of the measured value, At this time, employed as the development conditions were standard development conditions of a Kodak Dry View Processor 2771. It is preferable that the linearity approaches 10 percent.

TABLE 2

| Sample No. | Thickener | Viscosity of Coating Composition (in cP) 25° C. (a) | 5° C. (b) | Viscosity Ratio b/a | Uneven Density Rank | Finger-print Rank | Linea-rity in % | Remarks |
|---|---|---|---|---|---|---|---|---|
| 1 | — | 8 | 11 | 1.4 | 3 | 5 | 7.2 | Comp. |
| 2 | — | 10 | 14 | 1.4 | 3 | 6 | 7.2 | Comp. |
| 3 | Gelatin | 8 | 12 | 1.5 | 7 | 6 | 8.0 | Inv. |
| 4 | Gelatin | 10 | 19 | 1.9 | 6 | 6 | 7.9 | Inv. |
| 5 | Locust bean gum | 8 | 12 | 1.5 | 6 | 6 | 8.0 | Inv. |
| 6 | Locust bean gum | 10 | 18 | 1.8 | 7 | 7 | 8.2 | Inv. |
| 7 | Locust bean gum | 20 | 30 | 1.5 | 8 | 7 | 8.4 | Inv. |
| 8 | Locust bean gum | 500 | 1000 | 2.0 | 7 | 7 | 8.1 | Inv. |
| 9 | Locust bean gum | 600 | 2000 | 3.3 | 6 | 6 | 8.1 | Inv. |
| 10 | Sodium polyacrylate | 12 | 18 | 1.5 | 8 | 7 | 8.3 | Inv. |
| 11 | Guar gum | 13 | 20 | 1.5 | 8 | 8 | 8.2 | Inv. |
| 12 | Agar | 10 | 22 | 2.2 | 7 | 7 | 8.5 | Inv. |
| 13 | Sodium alginate | 14 | 30 | 2.1 | 7 | 7 | 8.4 | Inv. |
| 14 | Casein | 12 | 20 | 1.7 | 8 | 8 | 8.7 | Inv. |
| 15 | Xanthane | 13 | 22 | 1.7 | 7 | 8 | 8.4 | Inv. |
| 16 | Carrageenan | 12 | 30 | 2.5 | 7 | 7 | 8.3 | Inv. |
| 17 | Konjakmannan | 14 | 40 | 2.9 | 7 | 7 | 8.4 | Inv. |
| 18 | Lithium teniorite | 35 | 70 | 2.0 | 7 | 8 | 8.3 | Inv. |
| 19 | Saponite | 30 | 65 | 2.2 | 8 | 8 | 8.3 | Inv. |
| 20 | Hectorite | 34 | 60 | 1.8 | 7 | 7 | 8.3 | Inv. |
| 21 | Saponite | 33 | 60 | 1.8 | 7 | 7 | 8.1 | Inv. |
| 22 | Saponite/Behenic acid | 35 | 80 | 2.3 | 7 | 7 | 8.4 | Inv. |
| 23 | Saponite/Stearic acid | 33 | 78 | 2.4 | 8 | 8 | 8.5 | Inv. |
| 24 | Saponite/Lauric acid | 30 | 74 | 2.5 | 8 | 7 | 8.6 | Inv. |
| 25 | Locust bean gum & Sodium metaborate | 34 | 70 | 2.1 | 8 | 8 | 8.6 | Inv. |
| 26 | Polyvinyl alcohol, Boric acid, & Borax | 25 | 50 | 2.0 | 8 | 8 | 8.5 | Inv. |

It is found that in the constitution of the present invention, uneven density, fingerprint and linearity are improved.

Example 3

Samples were prepared in the same manner as Example 1, except that polymer latexes of the emulsion surface-protecting layer coating composition were replaced with compounds shown in Table 3. Table 3 shows the results.

Evaluation Method

Roller Marks

Each sample was wholly exposed employing a fluorescent lamp and processed under standard development conditions of a Kodak Dry View Processor 2771. Roller marks on the sample surface were then visually evaluated based on 10-rank criteria.

10: Roller marks were at all not noticed

8: Slightly roller marks were generated, but were at a level in which ordinary users did not notice the generation under circumstance for the use 6: Roller marks were definitely noticed under reflected light, but were at a level which did not resulted in problems of commercial viability 5: Roller marks were at a level which was in the lower limit for commercial viability

3:Roller marks were readily notice and were in a level of commercial unviability

TABLE 3

| Sample No. | Thickener | Major Binder Type | Tg/° C. | Viscosity of Coating Composition (in cP) 25° C.(a) | 5° C.(a) |
|---|---|---|---|---|---|
| 201 | Locust bean gum | Lacstar 3307B | 17 | 11 | 18 |
| 202 | Locust bean gum | Latex 1 | 55 | 13 | 20 |
| 203 | Locust bean gum | Latex 2 | 27 | 12 | 19 |
| 204 | Locust bean gum | Latex 3 | 66 | 12 | 19 |
| 205 | Locust bean gum | Latex 4 | 80 | 12 | 19 |
| 206 | Montmorillonite | Lacstar 3307B | 17 | 20 | 36 |
| 207 | Montmorillonite | Latex 1 | 55 | 20 | 36 |
| 208 | Montmorillonite | Latex 2 | 27 | 20 | 36 |
| 209 | Montmorillonite | Latex 3 | 66 | 20 | 36 |
| 210 | Montmorillonite | Latex 4 | 80 | 20 | 36 |

| Sample No. | Viscosity Ratio b/a | Uneven Density Rank | Finger-print Rank | Image Color Rank | Roller Marks Rank | Remarks |
|---|---|---|---|---|---|---|
| 201 | 1.6 | 6 | 7 | 7 | 5 | Inv. |
| 202 | 1.5 | 7 | 7 | 7 | 7 | Inv. |
| 203 | 1.6 | 7 | 7 | 7 | 7 | Inv. |
| 204 | 1.6 | 8 | 7 | 7 | 7 | Inv. |
| 205 | 1.6 | 6 | 7 | 7 | 7 | Inv. |
| 206 | 1.8 | 6 | 7 | 7 | 6 | Inv. |
| 207 | 1.8 | 7 | 7 | 7 | 7 | Inv. |
| 208 | 1.8 | 7 | 7 | 7 | 7 | Inv. |

TABLE 3-continued

| | | | | | | |
|---|---|---|---|---|---|---|
| 209 | 1.8 | 8 | 7 | 7 | 7 | Inv. |
| 210 | 1.8 | 6 | 7 | 7 | 7 | Inv. |

Tg: glass transition point in ° C.
Latex 1: copolymer of methyl methacrylate/styrene/2-ethylhexyl acrylate/2-hydroxyethyl methacrylate/acrylic acid = 59/9/26/5/1
Latex 2: copolymer of methyl methacrylate/styrene/2-ethylhexyl acrylate/2-hydroxyethyl methacrylate/acrylic acid = 45/9/40/5/1
Latex 3: copolymer of methyl methacrylate/styrene/2-ethylhexyl acrylate/2-hydroxyethyl methacrylate/acrylic acid = 64/12/18/5/1
Latex 4: copolymer of methyl methacrylate/styrene/2-ethylhexyl acrylate/2-hydroxyethyl methacrylate/acrylic acid = 69/14/11/5/1

It is found that when the Tg of main binders of the layer, which is located on the exterior of a layer comprising silver halide grains, is from 25 to 70° C., more improvements are realized.

Example 4

Samples were prepared in the same manner as Example 2, except that Contrast Increasing Agents H-1 and H-2 were replaced with H-3 and H-4, described below. The addition amount were 4.5 g and 2.0 g, respectively. Further, the polymer latexes of the emulsion surface-protecting layer coating composition were replaced with compounds shown in Table 4.

H-3

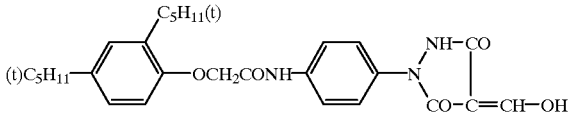

H-4

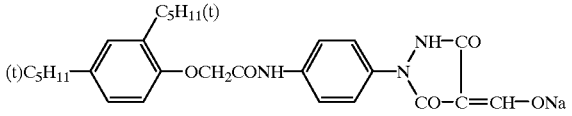

TABLE 4

| Sample No. | Thickener | Major Binder Type | Major Binder Tg/° C. | Viscosity of Coating Composition (in cP) 25° C.(a) | Viscosity of Coating Composition (in cP) 5° C.(a) |
|---|---|---|---|---|---|
| 301 | Locust bean gum | Lacstar 3307B | 17 | 11 | 18 |
| 302 | Locust bean gum | Latex 1 | 55 | 13 | 20 |
| 303 | Locust bean gum | Latex 2 | 27 | 12 | 19 |
| 304 | Locust bean gum | Latex 3 | 66 | 12 | 19 |
| 305 | Locust bean gum | Latex 4 | 80 | 12 | 19 |
| 306 | Montmorillonite | Lacstar 3307B | 17 | 20 | 36 |
| 307 | Montmorillonite | Latex 1 | 55 | 20 | 36 |
| 308 | Montmorillonite | Latex 2 | 27 | 20 | 36 |
| 309 | Montmorillonite | Latex 3 | 66 | 20 | 36 |
| 310 | Montmorillonite | Latex 4 | 80 | 20 | 36 |

| Sample No. | Viscosity Ratio b/a | Uneven Density Rank | Finger-print Rank | Image Color Rank | Roller Marks Rank | Remarks |
|---|---|---|---|---|---|---|
| 301 | 1.6 | 6 | 7 | 6 | 5 | Inv. |
| 302 | 1.5 | 7 | 7 | 7 | 7 | Inv. |
| 303 | 1.6 | 7 | 7 | 7 | 7 | Inv. |
| 304 | 1.6 | 8 | 7 | 7 | 7 | Inv. |

TABLE 4-continued

| | | | | | | |
|---|---|---|---|---|---|---|
| 305 | 1.6 | 6 | 7 | 6 | 7 | Inv. |
| 306 | 1.8 | 6 | 7 | 6 | 6 | Inv. |
| 307 | 1.8 | 7 | 7 | 7 | 7 | Inv. |
| 308 | 1.8 | 7 | 7 | 7 | 7 | Inv. |
| 309 | 1.8 | 8 | 7 | 7 | 7 | Inv. |
| 310 | 1.8 | 6 | 7 | 6 | 7 | Inv. |

Tg: glass transition point in ° C.
Latex 1: copolymer of methyl methacrylate/styrene/2-ethylhexyl acrylate/2-hydroxyethyl methacrylate/acrylic acid = 59/9/26/5/1
Latex 2: copolymer of methyl methacrylate/styrene/2-ethylhexyl acrylate/2-hydroxyethyl methacrylate/acrylic acid = 45/9/40/5/1
Latex 3: copolymer of methyl methacrylate/styrene/2-ethylhexyl acrylate/2-hydroxyethyl methacrylate/acrylic acid = 64/12/18/5/1
Latex 4: copolymer of methyl methacrylate/styrene/2-ethylhexyl acrylate/2-hydroxyethyl methacrylate/acrylic acid = 69/14/11/5/1

It is found that when the Tg of main binders of the layer, which is located on the exterior of a layer comprising siver halide grains, is from 25 to 70° C., more improvements are realized.

Example 5

Samples were prepared in the same manner as Example 3, except that phthalazine was replaced with phthalazine derivatives, sa shown in Table 5

TABLE 5

| Sample No. | Thickener | Major Binder Type | Major Binder Tg/° C. | Phthalazine Derivative | Viscosity of Coating Composition (in cP) 25° C.(a) | Viscosity of Coating Composition (in cP) 5° C.(a) |
|---|---|---|---|---|---|---|
| 401 | — | Latex 1 | 55 | Phthalazine | 8 | 11 |
| 402 | — | Latex 1 | 55 | 1-5 | 8 | 11 |
| 403 | Guar gum | Latex 1 | 55 | Phthalazine | 11 | 18 |
| 404 | Guar gum | Lacstar 3307B | 17 | 1-5 | 11 | 18 |
| 405 | Guar gum | Latex 1 | 55 | 1-5 | 11 | 18 |
| 406 | Guar gum | Latex 2 | 27 | 1-5 | 11 | 18 |
| 407 | Guar gum | Latex 3 | 66 | 1-5 | 11 | 18 |
| 408 | Guar gum | Latex 4 | 80 | 1-5 | 11 | 18 |
| 409 | Lithium teniorite | Latex 1 | 55 | Phthalazine | 11 | 18 |
| 410 | Lithium teniorite | Lacstar 3307B | 17 | 1-5 | 11 | 18 |
| 411 | Lithium teniorite | Latex 1 | 55 | 1-5 | 11 | 18 |
| 412 | Lithium teniorite | Latex 2 | 27 | 1-5 | 11 | 18 |
| 413 | Lithium teniorite | Latex 3 | 66 | 1-5 | 11 | 18 |
| 414 | Lithium teniorite | Latex 4 | 80 | 1-5 | 11 | 18 |

| Sample No. | Viscosity Ratio b/a | Uneven Density Rank | Fingerprint Rank | Image Color Rank | Remarks |
|---|---|---|---|---|---|
| 401 | 1.4 | 4 | 6 | 5 | Comp. |
| 402 | 1.4 | 4 | 6 | 5 | Comp. |
| 403 | 1.6 | 7 | 7 | 7 | Inv. |
| 404 | 1.6 | 7 | 7 | 7 | Inv. |
| 405 | 1.6 | 8 | 7 | 8 | Inv. |
| 406 | 1.6 | 8 | 7 | 8 | Inv. |
| 407 | 1.6 | 8 | 7 | 8 | Inv. |
| 408 | 1.6 | 7 | 7 | 7 | Inv. |
| 409 | 1.6 | 7 | 7 | 7 | Inv. |
| 410 | 1.6 | 7 | 7 | 7 | Inv. |
| 411 | 1.6 | 8 | 7 | 8 | Inv. |
| 412 | 1.6 | 8 | 7 | 8 | Inv. |

TABLE 5-continued

| | | | | | |
|---|---|---|---|---|---|
| 413 | 1.6 | 8 | 7 | 8 | Inv. |
| 414 | 1.6 | 7 | 7 | 7 | Inv. |

As can clearly be seen from Table 5, phthalazine derivatives result in further improvements.

Example 6

Samples were prepared in the same manner as Example 4, except that phthalazine was replaced with phthalazine derivatives shown in Table 6.

TABLE 6

| Sample | | Major Binder | | Phthalazine Derivative | Viscosity of Coating Composition (in cP) | |
|---|---|---|---|---|---|---|
| No. | Thickener | Type | Tg/° C. | | 25° C.(a) | 5° C.(a) |
| 501 | — | Latex 1 | 55 | Phthalazine | 8 | 11 |
| 502 | — | Latex 1 | 55 | 1-5 | 8 | 11 |
| 503 | Guar gum | Latex 1 | 55 | Phthalazine | 11 | 18 |
| 504 | Guar gum | Lacstar 3307B | 17 | 1-5 | 11 | 18 |
| 505 | Guar gum | Latex 1 | 55 | 1-5 | 11 | 18 |
| 506 | Guar gum | Latex 2 | 27 | 1-5 | 11 | 18 |
| 507 | Guar gum | Latex 3 | 66 | 1-5 | 11 | 18 |
| 508 | Guar gum | Latex 4 | 80 | 1-5 | 11 | 18 |
| 509 | Lithium teniorite | Latex 1 | 55 | Phthalazine | 11 | 18 |
| 510 | Lithium teniorite | Lacstar 3307B | 17 | 1-5 | 11 | 18 |
| 511 | Lithium teniorite | Latex 1 | 55 | 1-5 | 11 | 18 |
| 512 | Lithium teniorite | Latex 2 | 27 | 1-5 | 11 | 18 |
| 513 | Lithium teniorite | Latex 3 | 66 | 1-5 | 11 | 18 |
| 514 | Lithium teniorite | Latex 4 | 80 | 1-5 | 11 | 18 |

TABLE 6-continued

| Sample No. | Viscosity Ratio b/a | Uneven Density Rank | Fingerprint Rank | Linearity Rank | Remarks |
|---|---|---|---|---|---|
| 501 | 1.4 | 4 | 6 | 7.1 | Comp. |
| 502 | 1.4 | 4 | 6 | 7.2 | Comp. |
| 503 | 1.6 | 7 | 7 | 8.3 | Inv. |
| 504 | 1.6 | 7 | 7 | 8.1 | Inv. |
| 505 | 1.6 | 8 | 7 | 8.8 | Inv. |
| 506 | 1.6 | 8 | 7 | 8.9 | Inv. |
| 507 | 1.6 | 8 | 7 | 8.8 | Inv. |
| 508 | 1.6 | 7 | 7 | 8.2 | Inv. |
| 509 | 1.6 | 7 | 7 | 8.3 | Inv. |
| 510 | 1.6 | 8 | 7 | 8.0 | Inv. |
| 511 | 1.6 | 8 | 7 | 8.7 | Inv. |
| 512 | 1.6 | 8 | 7 | 8.7 | Inv. |
| 513 | 1.6 | 8 | 7 | 8.8 | Inv. |
| 514 | 1.6 | 7 | 7 | 8.1 | Inv. |

As can clearly be seen from Table 6, phthalazine derivatives result in further improvements.

Example 7

Samples were prepared in the same manner as Example 1, except that the coating speed was varied as shown in Table 7.

When the coating speed was 200, 400, or 500 m/minute, each sample was not sufficiently dried prior to winding under drying conditions shown in FIG. 1. Therefore, conditions described below were employed.

200 m/minute: from Zone 8 to Zone 10, DB was set at 60° C., WB was set at 27 0C., and relative humidity was set at 35 percent.

400 m/minute: from Zone 6 to Zone 10, DB was set at 60° C., WB set at 27° C., and relative humidity was set at 35 percent.

500 m/minute: from Zone 5 to Zone 10, DB was set at 60° C., WB set at 27 0C, and relative humidity was set at 35 percent.

TABLE 7

| Sample No. | Thickener | Coating Speed in m/min | Viscosity of Coating Composition (in cP) 25° C. (a) | 5° C. (b) | Viscosity Ratio b/a | Uneven Density Rank | Fingerprint Rank | Image Color Rank | Remarks |
|---|---|---|---|---|---|---|---|---|---|
| 601 | Sodium alginate | 40 | 13 | 25 | 1.9 | 7 | 6 | 7 | Inv. |
| 602 | Sodium alginate | 50 | 13 | 25 | 1.9 | 8 | 7 | 8 | Inv. |
| 603 | Sodium alginate | 200 | 13 | 25 | 1.9 | 8 | 8 | 8 | Inv. |
| 604 | Sodium alginate | 400 | 13 | 25 | 1.9 | 8 | 7 | 8 | Inv. |
| 605 | Sodium alginate | 500 | 13 | 25 | 1.9 | 7 | 7 | 7 | Inv. |
| 606 | Saponite | 40 | 25 | 45 | 1.8 | 7 | 6 | 7 | Inv. |
| 607 | Saponite | 50 | 25 | 45 | 1.8 | 8 | 7 | 8 | Inv. |
| 608 | Saponite | 200 | 25 | 45 | 1.8 | 8 | 8 | 8 | Inv. |
| 609 | Saponite | 400 | 25 | 45 | 1.8 | 8 | 7 | 8 | Inv. |
| 610 | Saponite | 500 | 25 | 45 | 1.8 | 7 | 6 | 7 | Inv. |

As can clearly be seen from Table 7, the coating speed in the range of 50 to 400 m/minute results in further improvements.

Example 8

Samples were prepared in the same manner as Example 2, except that coating was carried out at each speed shown in Table 8

When the coating speed was 200, 400, or 500 m/minute, each sample was not sufficiently dried until winding under drying conditions shown in FIG. 1. Therefore, conditions described below were employed.

200 m/minute: from Zone 8 to Zone 10, DB was set at 60° C., WB set at 27° C., and relative humidity was set at 35 percent.

400 m/minute: from Zone 6 to Zone 10, DB was set at 60° C., WB set at 27 0C., and relative humidity was set at 35 percent.

500 m/minute: from Zone 5 to Zone 10, DB was set at 60° C., WB set at 27° C., and relative humidity was set at 35 percent.

As can clearly be seen from Table 8, the coating speed in the range of 50 to 400 m/minute results in still further improvements.

Example 9

Samples were prepared in the same manner as Example 1, except that air was blown from minute holes of the conveying rollers in the drying process so that each support was conveyed while being floated about 1 mm above the roller surface so as to result in no contact between said support and said roller surface. The conveying speed was set at 130 m/minute under the drying conditions shown in FIG. 1.

In the conveying rollers from Zone 1 to Zone 10, minute holes, having a diameter of 0.5 mm, were provided at about 1 cm interval so as to form a spiral in the circumferential direction. Said support floated due to blowing air from said holes.

TABLE 8

| Sample No. | Thickener | Coating Speed in m/min | Viscosity of Coating Composition (in cP) 25° C. (a) | 5° C. (b) | Viscosity Ratio b/a | Uneven Density Rank | Fingerprint Rank | Linearity in % | Remarks |
|---|---|---|---|---|---|---|---|---|---|
| 701 | Sodium alginate | 40 | 13 | 25 | 1.9 | 7 | 6 | 8.1 | Inv. |
| 702 | Sodium alginate | 50 | 13 | 25 | 1.9 | 8 | 7 | 8.3 | Inv. |
| 703 | Sodium alginate | 200 | 13 | 25 | 1.9 | 8 | 8 | 8.3 | Inv. |
| 704 | Sodium alginate | 400 | 13 | 25 | 1.9 | 8 | 7 | 8.3 | Inv. |
| 705 | Sodium alginate | 500 | 13 | 25 | 1.9 | 7 | 7 | 8.2 | Inv. |
| 706 | Saponite | 40 | 25 | 45 | 1.8 | 7 | 6 | 8.1 | Inv. |
| 707 | Saponite | 50 | 25 | 45 | 1.8 | 8 | 7 | 8.2 | Inv. |
| 708 | Saponite | 200 | 25 | 45 | 1.8 | 8 | 8 | 8.2 | Inv. |
| 709 | Saponite | 400 | 25 | 45 | 1.8 | 8 | 7 | 8.2 | Inv. |
| 710 | Saponite | 500 | 25 | 45 | 1.8 | 7 | 6 | 8.1 | Inv. |

TABLE 9

| Sample No. | Thickener | Conveying Roller | Viscosity of Coating Composition (in cP) 25° C. (a) | 5° C. (b) | Viscosity Ratio b/a | Uneven Density Rank | Fingerprint Rank | Image Color Rank | Remarks |
|---|---|---|---|---|---|---|---|---|---|
| 801 | Xanthane | contact | 15 | 30 | 2.0 | 7 | 7 | 7 | Present invention |
| 802 | Xanthane | non-contact | 15 | 30 | 2.0 | 8 | 7 | 8 | Present invention |
| 803 | Hectorite | contact | 18 | 32 | 1.8 | 7 | 7 | 7 | Present invention |
| 804 | Hectorite | non-contact | 18 | 32 | 1.8 | 8 | 7 | 8 | Present invention |

As can clearly be seen from Table 9, non-contact with the conveying rollers results in further improvements.

Example 10

Samples were prepared in the same manner as Example 2, except that air was blown from minute holes of the conveying rollers during the drying process so that each support was conveyed while being floated about 0.1 mm above the roller surface so as to achieve no contact between said support and said roller surface. The conveying speed was set at 130 m/minute under the drying conditions shown in FIG. 1.

In the conveying rollers from Zone 1 to Zone 10, minute holes, having a diameter of 0.5 mm, were provided at about 1 cm interval so as to form a spiral in the circumferential direction. Said support floated due to blowing air from said holes.

TABLE 10

| Sample No. | Thickener | Conveying Roller | Viscosity of Coating Composition (in cP) 25° C. (a) | 5° C. (b) | Viscosity Ratio b/a | Uneven Density Rank | Finger-print Rank | Linea-rity in % | Remarks |
|---|---|---|---|---|---|---|---|---|---|
| 901 | Xanthane | contact | 15 | 30 | 2.0 | 7 | 7 | 8.1 | Present invention |
| 902 | Xanthane | non-contact | 15 | 30 | 2.0 | 8 | 7 | 8.5 | Present invention |
| 903 | Hectorite | contact | 18 | 32 | 1.8 | 7 | 7 | 8.1 | Present invention |
| 904 | Hectorite | non-contact | 18 | 32 | 1.8 | 8 | 7 | 8.6 | Present invention |

As can clearly be seen from Table 9, non-contact with the conveying rollers results in further improvements.

In the present Examples, the backing layer/the protective layer was separately coated. It was confirmed that by incorporating Gelation Promoting Agents into the protective layer on the backing side, it was possible to increase the coating speed as well as to enhance productivity.

Further, it was also confirmed that it was possible to carry out simultaneous coating onto the backing side and the emulsion side, employing such a process as comprising a backing coating coater, a cooling zone, an emulsion surface side coater, a cooling zone, and drying.

The present intention makes it possible to provide a heat developable photosensitive material which results in improvements of image color, uneven density, and linearity.

Disclosed embodiment can be varied by a skilled person without departing from the spirit and scope of the invention.

What is claimed is:

1. A heat developable photosensitive material comprising a support, a first layer containing an organic silver salt, photosensitive silver halide and a reducing agent, and a second layer which is provided on same side of the first layer and farther from the support than the first layer, wherein the first layer is formed by coating a first coating composition containing the organic silver salt, the photosensitive silver halide, the reducing agent, polymer latex in an amount of at least 30 percent by weight of the first layer in dried state and a solvent, the solvent comprising water in an amount of at least 50 percent by weight of the solvent, and the second layer is formed by coating a second coating composition comprising a polymer latex in an amount of at least 50 percent by weight of the second layer in dried state, a thickener and a solvent, the solvent comprising water in an amount of at least 60 percent by weight of the solvent, and the second coating composition having a viscosity of from 4 to 1,000 cP at 25° C., and the viscosity at 5° C. being at least 1.5 times higher than that at 25° C.

2. The heat developable photosensitive material of claim 1 wherein the first coating composition and the second coating composition are coated simultaneously, whereby the first layer and the second layer are formed.

3. The heat developable photosensitive material of claim 1 wherein the second layer is an outermost layer.

4. The heat developable photosensitive material of claim 1 wherein the polymer latex in the second coating composition has a glass transition point of from 25 to 70° C.

5. The heat developable photosensitive material of claim 1 wherein the polymer latex in the first coating composition has a glass transition point of from −30 to 40° C.

6. The heat developable photosensitive material of claim 1 wherein the first or second coating composition comprises a phthalazine derivative.

7. The heat developable photosensitive material of claim 1 wherein the second coating composition is gelled at a temperature which is at least 15° C. lower than the temperature of the second coating composition at a time of coating.

8. The heat developable photosensitive material of claim 1 wherein the second coating composition comprises a gelation promoting agent.

9. The heat developable photosensitive material of claim 1 wherein the thickener is selected from the group consisting of gelatin, guar gum, casein, pectin, sodium cellulose glycolate, sodium alginate, sodium polyacrylate, agar, carrageenan, gluten, xanthane, methyl cellulose, locust bean gum, galactan, konjakmannan, polyvinyl alcohol and colloidal aluminum silicate.

10. The heat developable photosensitive material of claim 9 wherein the thickener selected from the group consisting of xanthane, locust bean gum, carrageenan, konjakmannan, polyvinyl alcohol, montmorillonite and synthetic mica.

11. The heat developable photosensitive material of claim 1 wherein the thickener is selected from the group consisting of gelatin, guar gum, casein, pectin, sodium cellulose glycolate, sodium alginate, sodium polyacrylate, agar, carrageenan, gluten, xanthane, methyl cellulose, locust bean gum, galactan, konjakmannan and polyvinyl alcohol.

12. The heat developable photosensitive material of claim 8 wherein the gelation promoting agent is boric acid salt.

13. The heat developable photosensitive material of claim 8 wherein the gelation promoting agent is a fatty acid or a quaternary ammonium salt.

14. The heat developable photosensitive material of claim 1 wherein the second layer is a protective layer.

15. A method for preparation of a heat developable photosensitive material comprising coating, on a support, a first coating composition containing an organic silver salt, photosensitive silver halide, a reducing agent, polymer latex in an amount of at least 30 percent by weight of the first layer at dried state and a solvent, the solvent comprising water in an amount of at least 60 percent by weight of the solvent, to form a first layer and coating, a second coating composition comprising a polymer latex in an amount of at least 50 percent by weight of the second layer at dried state, a thickener and a solvent, the solvent comprising water in an amount of at least 60 percent by weight of the solvent, and the second coating composition having a viscosity of from 4 to 1,000 cP at 25° C., and the viscosity at 5° C. being at least 1.5 times higher than that at 25° C. to form a second layer in same side of the first layer provided farther from the support than the first layer.

16. The method of claim 15, wherein the first coating composition and the second coating composition are coated simultaneously.

17. The method of claim 15, wherein the first coating composition or the second coating composition is coated at a coating speed of from 50 to 400 m/minute.

18. The method of claim 15, wherein the method further comprises drying heat developable photosensitive material after forming the first layer and the second layer, drying being carried out so that said material is not brought into contact with a conveying roller.

* * * * *

UNITED STATES PATENT AND TRADEMARK OFFICE

CERTIFICATE OF CORRECTION

PATENT NO. : 6,551,770 B2
DATED : April 22, 2003
INVENTOR(S) : Kazuhiko Hirabayashi It is certified that error appears in the above-identified patent and that said Letters Patent is hereby corrected as shown below:

Column 34,
Line 4, "25° C. to" should read -- 25° C., to --.

Signed and Sealed this

Ninth Day of December, 2003

JAMES E. ROGAN
*Director of the United States Patent and Trademark Office*